US006663427B1

(12) United States Patent
Billman et al.

(10) Patent No.: US 6,663,427 B1
(45) Date of Patent: Dec. 16, 2003

(54) HIGH DENSITY ELECTRICAL CONNECTOR ASSEMBLY

(75) Inventors: Timothy B. Billman, Dover, PA (US); Eric D. Juntwait, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/192,048

(22) Filed: Jul. 9, 2002

Related U.S. Application Data

(63) Continuation-in-part of application No. 10/154,318, filed on May 22, 2002.

(51) Int. Cl.[7] ..... H01R 13/648
(52) U.S. Cl. ..... 439/608; 439/108
(58) Field of Search ..... 439/608, 108, 439/101, 79, 76.1, 701

(56) References Cited

U.S. PATENT DOCUMENTS 5,980,321 A * 11/1999 Cohen et al. ..... 439/608
5,993,259 A * 11/1999 Stokoe et al. ..... 439/608
6,083,047 A * 7/2000 Paagman ..... 439/608
6,146,202 A * 11/2000 Ramey et al. ..... 439/608
6,152,747 A * 11/2000 McNamara ..... 439/108
6,238,245 B1 * 5/2001 Stokoe et al. ..... 439/608
6,273,762 B1 * 8/2001 Regnier ..... 439/701
6,293,827 B1 * 9/2001 Stokoe ..... 439/608
6,299,483 B1 * 10/2001 Cohen et al. ..... 439/608

* cited by examiner

*Primary Examiner*—Gary Paumen
*Assistant Examiner*—James Harvey
(74) *Attorney, Agent, or Firm*—Wei Te Chung

(57) ABSTRACT

An electrical connector assembly comprises a receptacle (1) and a header (8). The receptacle comprises a first interface connection piece (20) including a plurality of first wafers (21) assembled together to define a plurality of slots (200) between adjacent first wafers. Each first wafer includes a plurality of signal terminals and a grounding member mounted on opposite sides of a dielectric base thereof. A plurality of daughter circuit boards (30) each has a first mating portion (302) and a second mating portion (300). The mounting portions are inserted into the slots of the first interface connection piece and engage with the signal contacts and the grounding member. The header has a second interface connection piece (90) including a plurality of second wafers (91) assembled together to define a plurality of slots (900) between adjacent second wafers. Each second wafer has an identical construction with that of the first wafer. The second mating portions are inserted into the slots of second interface connection piece and engage with signal contacts and grounding member of the second wafers.

1 Claim, 14 Drawing Sheets

HIGH DENSITY ELECTRICAL CONNECTOR ASSEMBLY

CROSS-REFERENCE TO RELATED APPLICATION

This patent application is a continuation-in-part (C-I-P) application of U.S. patent application Ser. No. 10/154,318, filed May 22, 2002, invented by Timothy Brain Billman, entitled "HIGH DENSITY ELECTTICAL CONNECTOR" and assigned to the same assignee of this patent application.

BACKGROUND OF THE INVENTION

1. Field of the Invention

The present invention relates to an electrical connector assembly, and particularly to a high density electrical connector assembly having a receptacle and a header with identical wafers assembled thereto.

2. Description of Related Art

With the development of communication and computer technology, high density electrical connectors with conductive elements in a matrix arrangement are desired to construct a large number of signal transmitting paths between two electronic devices. Such high density electrical connectors are widely used in internal connecting systems of severs, routers and the like devices requiring high speed data processing and communication.

These connectors generally comprise two mating connector halves, i.e., a header connector connecting with a backplane and a receptacle connector connecting with a daughter card. The backplane and the daughter card are positioned in parallel or perpendicularity to each other. The mating connector halves of one type can be referred to Berg Product Catalog published on January 1998, and the website of Teradyne, Inc, at the following internet address: http://www.teradyne.com/prods/tcs/products/hpi/vhdm/modoconfig.html. Each connector comprises an overmolded carrier made of dielectric material and multiple rows and columns of contacts. Each column of the contacts is provided as a separate module. Multiple modules are installed in the insulating carrier to form a complete connector. Generally, all of the modules are substantially identical. When it is desired to have different types of modules in the connector in order to meet different requirements of signal transmission, a problem is raised that additional tooling and handling are required for the different types of the modules, thereby increasing manufacturing cost.

U.S. Pat. No. 6,152,747, issued to Teradyne, Inc., discloses two mating connector halves 12 and 14 of another type. Each connector half 12 (14) disclosed therein comprises a dielectric housing 20 (200) defining a plurality of slots therein and a plurality of wafer-like modules 42 (230) retained in respective slots. Each wafer-like module includes a dielectric support and a plurality of signal and grounding contacts attached at its opposite sides, respectively. However, the configurations of the wafer-like modules 42 and 230 are different so that they can not be exchanged to be used in the connector half other than they are originally assigned to.

U.S. Pat. No. 6,293,827 discloses an electrical connector providing a wafer assembly 205 having three wafers 210, 212 and 214. Each wafer 210, 212 and 214 has a housing 220A–220C and a plurality of signal contacts 218 held on the housing 220A–220C. Each of the three wafers 210, 212 and 214 has a certain configuration which is different from that of other two wafers. Therefore, three molds must be used to form the wafers. It is costly to manufacture these wafers.

A pair of mating connectors 11 and 18 is disclosed in U.S. Pat. No. 6,267,604. The connector 11 comprises a front housing portion 20 having a front wall 21 with a plurality of parallel apertures 22 extending therethrough, an organizer 30 attached to the front housing portion 20, and a plurality of individual circuit boards or wafers 13 retained between the front housing portion and the organizer. The organizer has a plurality of spaced slots 34 located corresponding to the apertures 22, and a plurality of openings 33 communicating with the slots in a bottom wall thereof. The wafers have mating portions extending through the apertures of the front housing portion for mating with the mating connector 18, and mounting edges received in the slots of the organizer. The mounting edges of the wafers have a plurality of terminals 50 secured thereon by soldering. The terminals extend through respective openings of the organizer for electrically connecting with a circuit substrate. The wafers 13 can not be used in the mating connector 18 to achieve transmitting signal function. Additional contacts 51 must be provided, which results in additional expenditure.

Furthermore, the '604 patent has the shortcoming that connecting the terminals to the wafers is complicate and time-consuming. Furthermore, once the terminals are connected with the wafers, the terminals cannot be separated from the wafers. If the terminals or wafers are damaged, both of them must be replaced together, thereby increasing the cost of production. In addition, when the wafers are assembled to the organizer, the terminals secured on the wafers need to be received in the respective openings of the organizer for fixing the terminals, thereby increasing the difficulty of assemblage of the wafers.

U.S. Pat. No. 5,980,321 also discloses a backplane assembly which comprises a pin header 114 and a daughter card connector 116. The daughter card connector 116 comprises a wafer 154 having a signal piece 168 and a shield piece 166. Configurations of these pieces 168 and 166 are different with each other; thus, the cost of the connector is high.

Hence, an improved electrical connector assembly is required to overcome the disadvantages of the related art.

SUMMARY OF THE INVENTION

Accordingly, an object of the present invention is to provide a high density electrical connector assembly having a plurality of identical wafers assembled in a header and a receptacle of the assembly for reducing the manufacturing cost of the connector assembly.

In order to achieve the objects set forth, an electrical connector assembly comprises a receptacle and a header. The receptacle comprises a first interface connection piece including a plurality of individual first wafers assembled together to define a plurality of slots between adjacent first wafers. Each first wafer includes a dielectric base and a plurality of signal terminals and a grounding member respectively mounted on opposite sides of the dielectric base. The signal contacts and the grounding member have tail portions for connecting to a printed circuit board and contacting portions located at the same side of the dielectric base. A plurality of daughter circuit boards each has a first mating portion and a second mating portion. The first mating portions of the circuit boards are inserted into the slots of the first interface connection piece and mechanically and electrically engage with the contacting portions of the signal contacts and the grounding member. The header for electrically connecting a backplane has a second interface connection piece including a plurality of individual second wafers assembled together to define a plurality of slots between adjacent second wafers. Each second wafer has an identical construction with that of the first wafer of the first interface connection piece. The second mating portions of the circuit boards are inserted into the slots of second interface connection piece and mechanically and electrically engage with signal contacts and grounding member of the second wafers for establishing an electrical connection between the printed circuit board and the backplane.

Other objects, advantages and novel features of the invention will become more apparent from the following detailed description when taken in conjunction with the accompanying drawings.

DETAILED DESCRIPTION OF THE INVENTION

Figure 1:
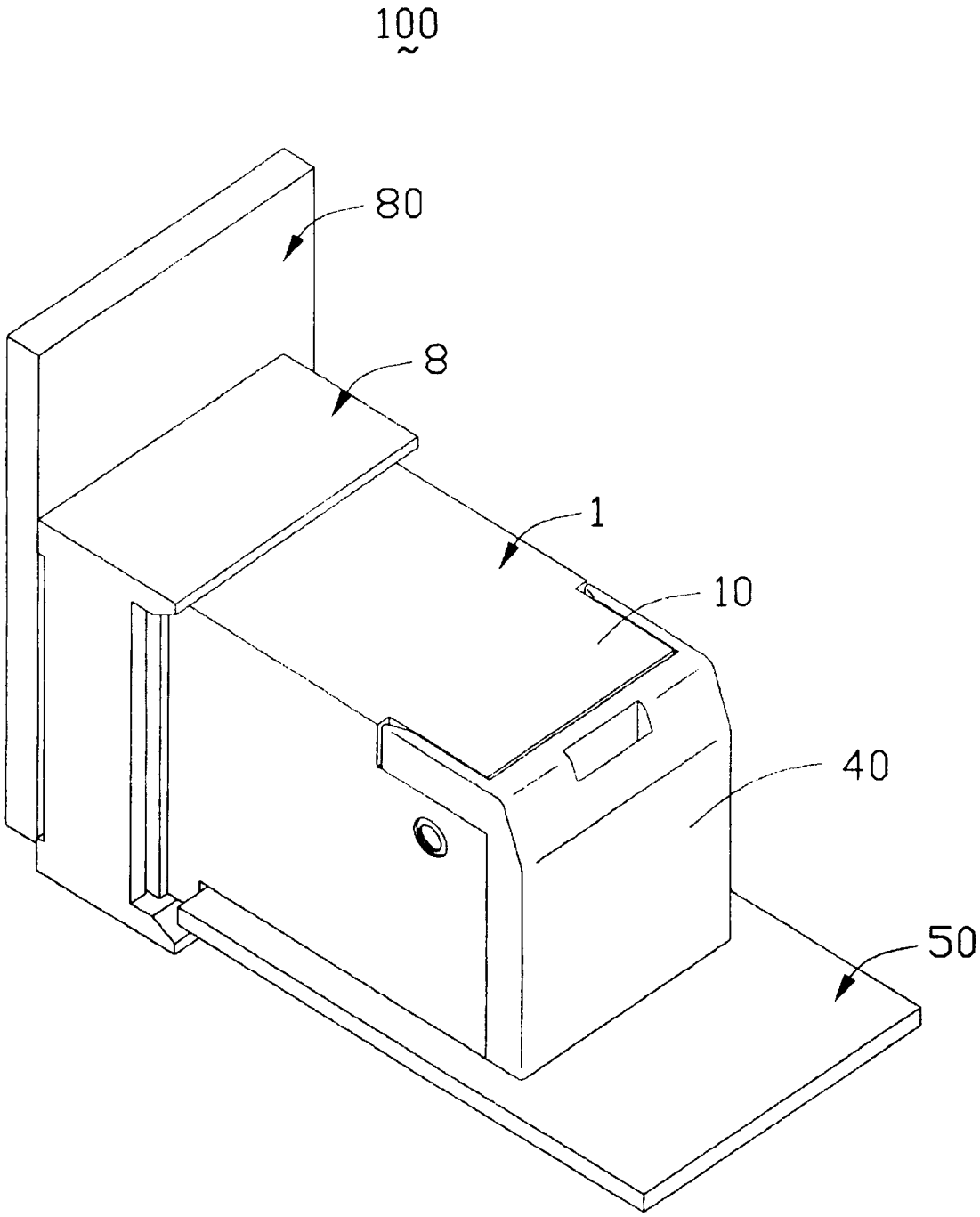
FIG. 1 is a perspective view of a high density electrical connector assembly showing a receptacle and a header thereof in a mated condition and connecting with a daughter card and a backplane.

Referring to FIG. 1, a high density electrical connector assembly 100 in accordance with the present invention comprises a receptacle 1 mounted on a daughter card 50 and a header 8 mounted on a backplane 80.

Referring to FIGS. 2–5, the receptacle 1 comprises a dielectric housing 10, a first interface connection piece 20, a plurality of circuit boards 30 retained between the housing 10 and the interface connection piece 20, and a fastening device 40 for securing the first interface connection piece 20 to the housing 10. Each of the circuit boards 30 includes a dielectric substrate made of conventional circuit board substrate material, such as FR4, a plurality of conductive signal and grounding traces on one side of the substrate for providing electrical paths through the receptacle 1, and a layer of conductive material coated on an opposite side of the substrate for providing a grounding plane to the substrate.

Figure 6:
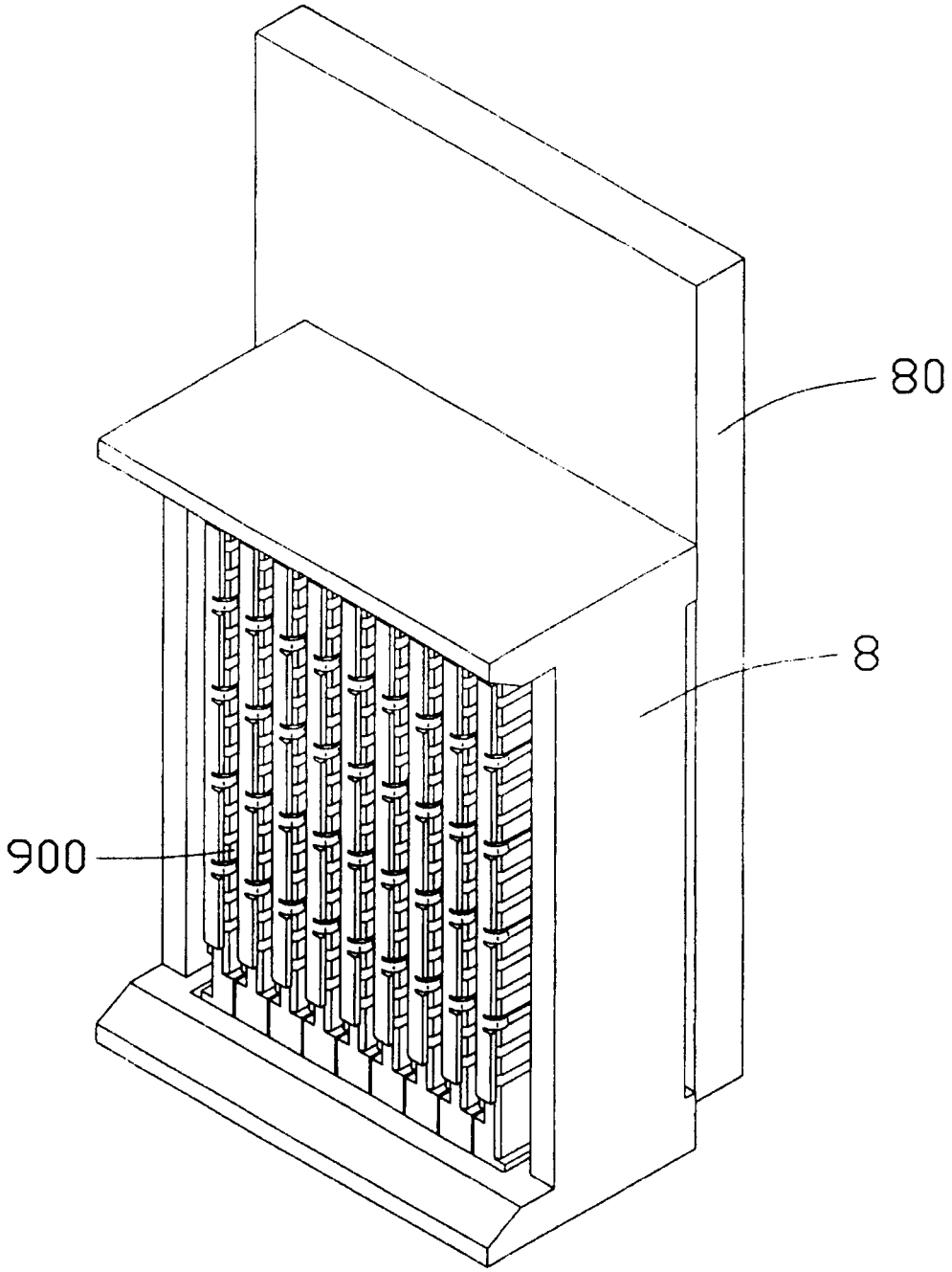
FIG. 6 is a perspective view of the header mounted on the backplane of FIG. 1, from a different aspect.

The dielectric housing 10 is generally in a rectangular shape. The housing 10 defines a front mating port 12 for insertion into the header 8 (also referring to FIG. 6) when the receptacle 1 and the header 8 mate with each other. The header 8 is used for connecting with a backplane 80. The housing 10 defines an opening 13 in a bottom face 100 and a rear face 102 thereof, and a plurality of parallel channels 14 in communication with the opening 13. The channels 14 extend in a longitudinal direction of the housing 10 between the front mating port 12 and the rear face 102. The housing 10 defines a pair of recesses 15 in opposite side faces 104 thereof adjacent to the rear face 102, and a pair of cavities 16 recessed from the recesses 15. An aperture 17 is defined transversely through the opposite side faces 104 of the housing 10 near the rear face 102.

Figure 9:
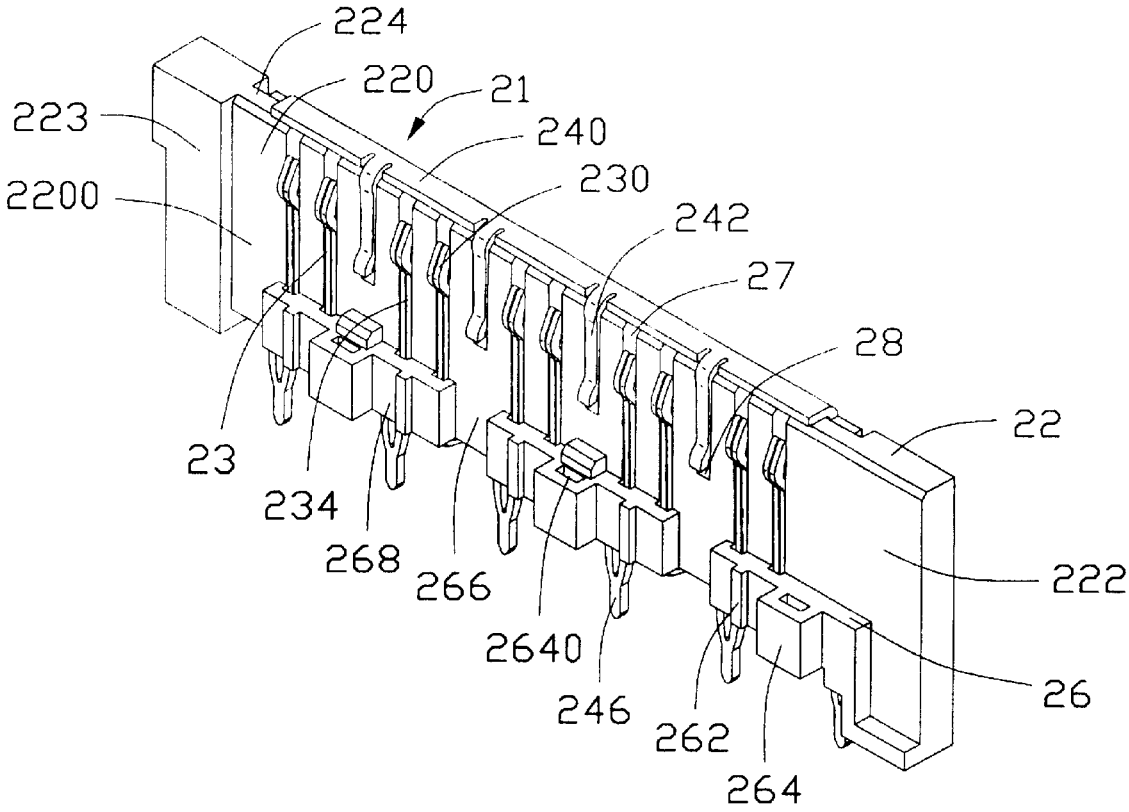
FIG. 9 is an enlarged perspective view of a wafer of the receptacle and the header shown in FIG. 5 and FIG. 7.
Figure 10:
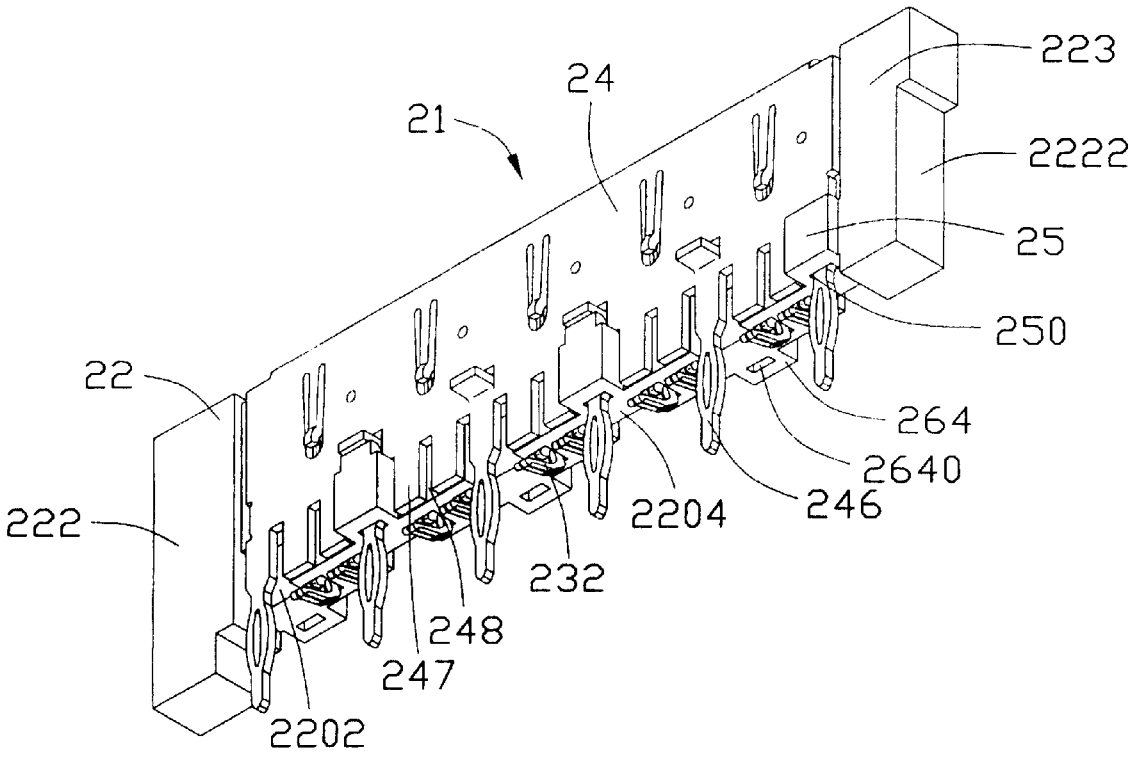
FIG. 10 is a view similar to FIG. 9 but taken from a different aspect.
Figure 11:
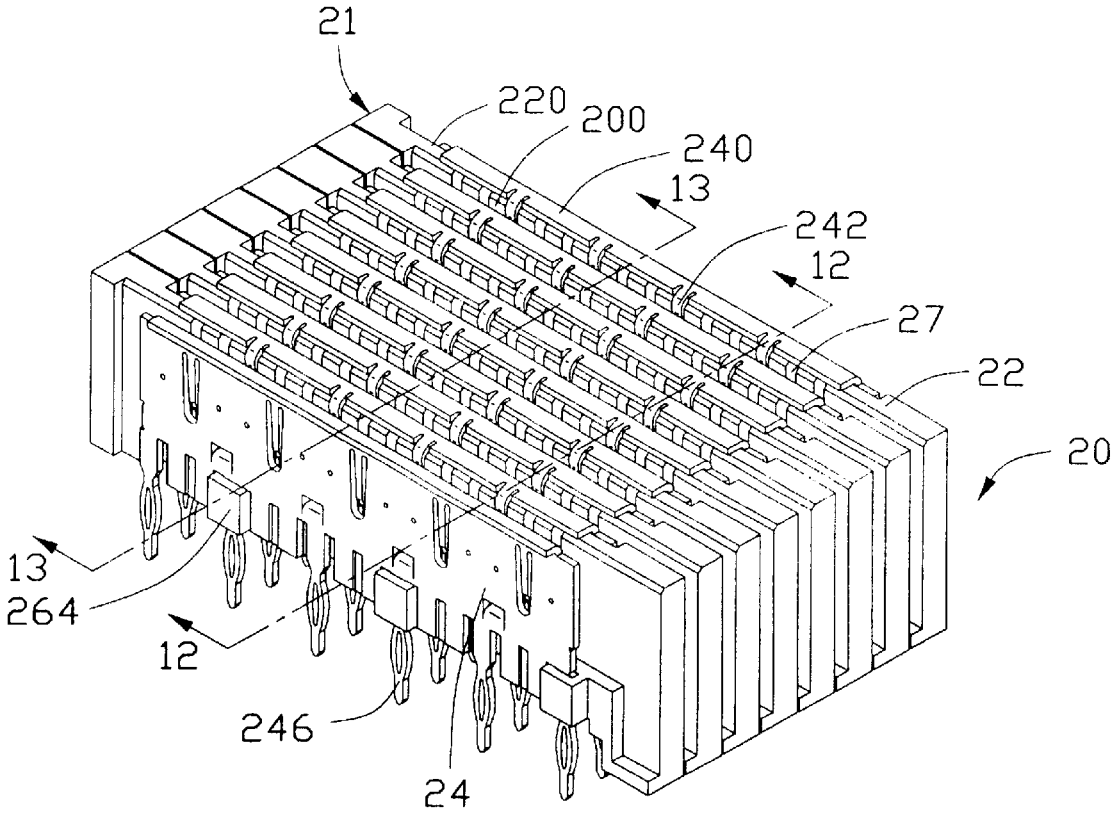
FIG. 11 is a perspective view showing a number of the wafer of FIG. 9 assembled together.

Referring to FIGS. 9–13, the first interface connection piece 20 consists of a plurality of first wafers 21. In the preferred embodiment, each one of the first wafers 21 is identical in construction, and an exemplary one thereof is shown in FIGS. 9 and 10. The first wafer 21 includes a dielectric base 22 and a plurality of signal terminals 23 and a grounding bus 24 respectively mounted on opposite sides of the dielectric base 22. The dielectric base 22 has a body portion 220 and front and rear end portions 222, 223. The rear end portion 223 defines a depression 2222 in a rear side thereof.

The body portion 220 of the dielectric base 22 has substantially planar side surfaces 2200, 2202. The body portion 220 forms a plurality of first and second blocks 25, 26 respectively on the side surfaces 2202, 2200. The first and the second blocks 25, 26 are located adjacent to a bottom surface 2204 of the body portion 220 in a staggered manner. Bottom faces of the first and the second blocks 25, 26 are flush with the bottom surface 2204 of the body portion 220 of the dielectric base 22. Each second block 26 includes a pair of ribs 262 and an embossment 264 located between the ribs 262. The side surface 2200 of the body portion 220 of the dielectric base 22 defines a plurality of slots 27 extending through the second blocks 26 to thereby running through a whole height of the body portion 220. The side surface 2200 of the dielectric base 22 also defines a plurality of recesses 28 adjacent to a top edge 224 of the body portion 220 between every two slots 27.

Referring to FIGS. 11–14 in conjunction with FIGS. 9 and 10, the plurality of first wafers 21 is assembled together to form the first interface connection piece 20. A plurality of parallel slots 200 is defined between adjacent first wafers 21 for receiving the circuit boards 30 therein. When assembling, the rear end portions 223 of the first wafers 21 are aligned with each other, and the first blocks 25 of each first wafer 21 have an interferential fit with corresponding recesses 266 defined between the second blocks 26 of an adjacent first wafer 21.

Subsequently, the plurality of signal terminals 23 and the grounding buses 24 are assembled onto the first interface connection piece 20 to thereby make each first wafer 21 with the signal terminals 23 received in the slots 27 in the side surface 2200, and with the grounding bus 24 disposed on the side surface 2202 of the first wafer 21. Each slot 27 receives a pair of signal terminals 23 therein. The signal terminals 23 are stamped from a single piece of metal sheet. Each signal terminal 23 includes a curved contacting portion 230 raised outside of the side surface 2200 of the dielectric base 22 for contacting with the signal traces of an inserted circuit board 30, a bent tail portion 232 extending toward the side surface 2202 of the dielectric base 22, and an intermediate portion 234 interconnecting the contacting portion 230 with the bent tail portion 232. There exists a clearance (not labeled) between the bent tail portion 232 and the bottom surface 2204 of the dielectric base 22.

The grounding bus 24 is formed as a single piece snugly bearing against the side surface 2202 of the corresponding dielectric base 22. The grounding bus 24 has a top flange 240 covering the top edge 224 of the body portion 220, and a plurality of contacting legs 242 extending downwardly from the top flange 240 to be aligned with the recesses 28 of the dielectric base 22. A top end of each contacting leg 242 and the top flange 240 opposite to the contacting legs 242 respectively functions as a lead-in for facilitating insertion of the circuit board 30 into a corresponding slot 200. In addition, the grounding bus 24 has press-fit tails 246 for fittingly engaging with the daughter card 50. The tails 246 have a number which is the same as that of the first and the second blocks 25, 26 of the wafer 21. The grounding bus 24 also has several flaps 247 and slots 248 defined between two adjacent press-fit tails 246. The press-fit tails 246 extend beyond the bottom surface 2204 of the dielectric base 22 through apertures 250, 2640 respectively defined in the first blocks 25 of each wafer 21 and the second blocks 26 of an adjacent wafer 21. The flaps 247 of the grounding bus 24 are received in recesses 268 in the second blocks 26 of an adjacent wafer 21. Thus, the flaps 247 are disposed between the signal terminals 23 mounted on the two adjacent first wafers 21 for functioning as a shell near ends of the signal terminals 23. The ribs 262 of the second blocks 26 of each wafer 21 are received in some of the slots 248 of an adjacent wafer 21.

Referring back to FIGS. 1–5, each of the circuit boards 30 has a first mating portion 302, a second mating portion 300 and a rearward edge 304. After the first interface connection piece 20 is formed, the circuit boards 30 are respectively inserted into the slots 200 formed between the wafers 21. The first mounting portion 302 of the circuit board 30 is received in a corresponding slot 200 to thereby electrically engage with the signal terminals 23 and the grounding bus 24 of the first wafer 21. The contacting portions 230 of the signal terminals 23 electrically contact with the signal traces on the circuit board 30, and the contacting legs 242 of the grounding bus 24 electrically contact with the grounding traces on the circuit board 30. The rearward edges 304 of the circuit boards 30 abut against the rear end portions 223 of the dielectric bases 22.

The first interface connection piece 20 with the parallel circuit boards 30 received therein is then attached to the dielectric housing 10 in a back-to-front direction. The first interface connection piece 20 is received in the opening 13 of the housing 10. The channels 14 of the housing 10 guide the mating portions 300 of the circuit boards 30 into the mating port 12 of the housing 10. Finally, the fastening device 40 is attached to the housing 10 for fixing the first interface connection piece 20 with the housing 10. The fastening device 40 includes a rear wall 400 covering with the rear face 102 of the housing 10, and a pair of latches 402 forwardly extending from opposite side edges of the rear wall 400. Each latch 402 has a hook 404 at a free end thereof. The latches 402 are received in the recesses 15 of the housing 10 and the hooks 404 are locked in the cavities 16 of the housing 10. The rear wall 400 has a protrusion 406 on an inner face thereof for abutting against a top face of the depression 2222 of the interface connection piece 20, whereby the housing 10 and the interface connection piece 20 are stably connected with each other. A cylinder pin 60 is inserted into through holes 32 of the circuit boards 30 through the aperture 17 of the housing 10 for keeping the circuit boards 30 in their original position rather than be pushed back when the receptacle 1 mates with the header 8.

Figure 2:
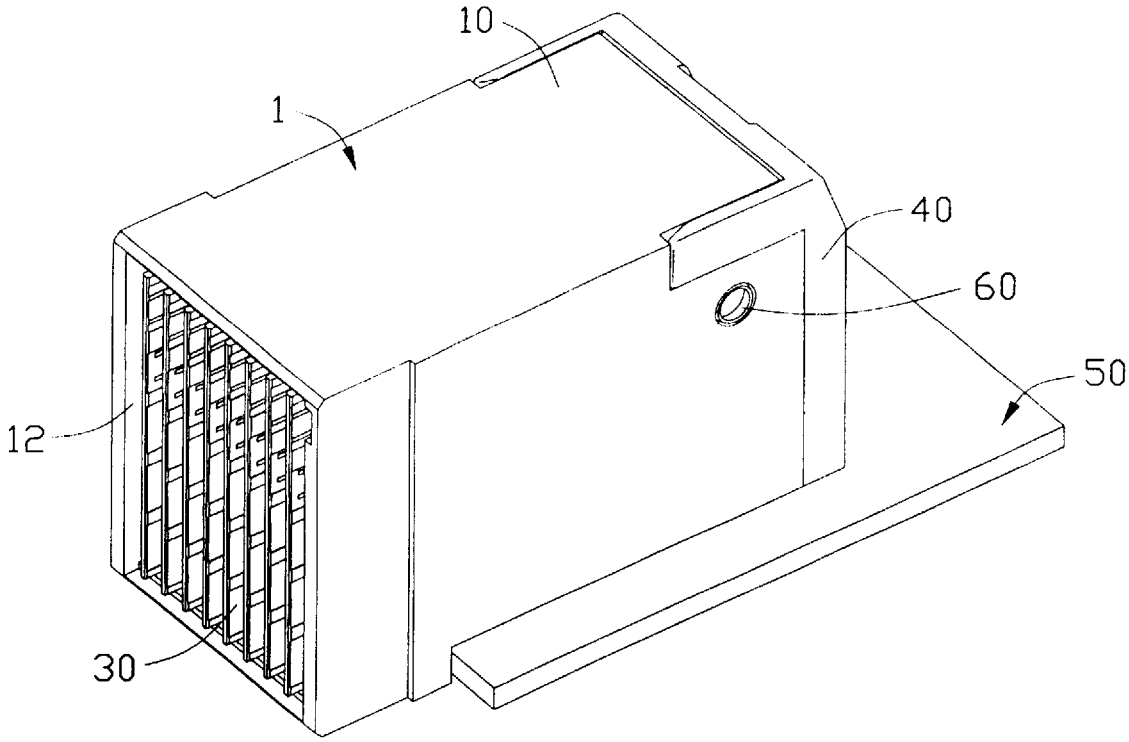
FIG. 2 is a perspective view of the receptacle mounted on the daughter card of FIG. 1, from a different aspect.
Figure 3:
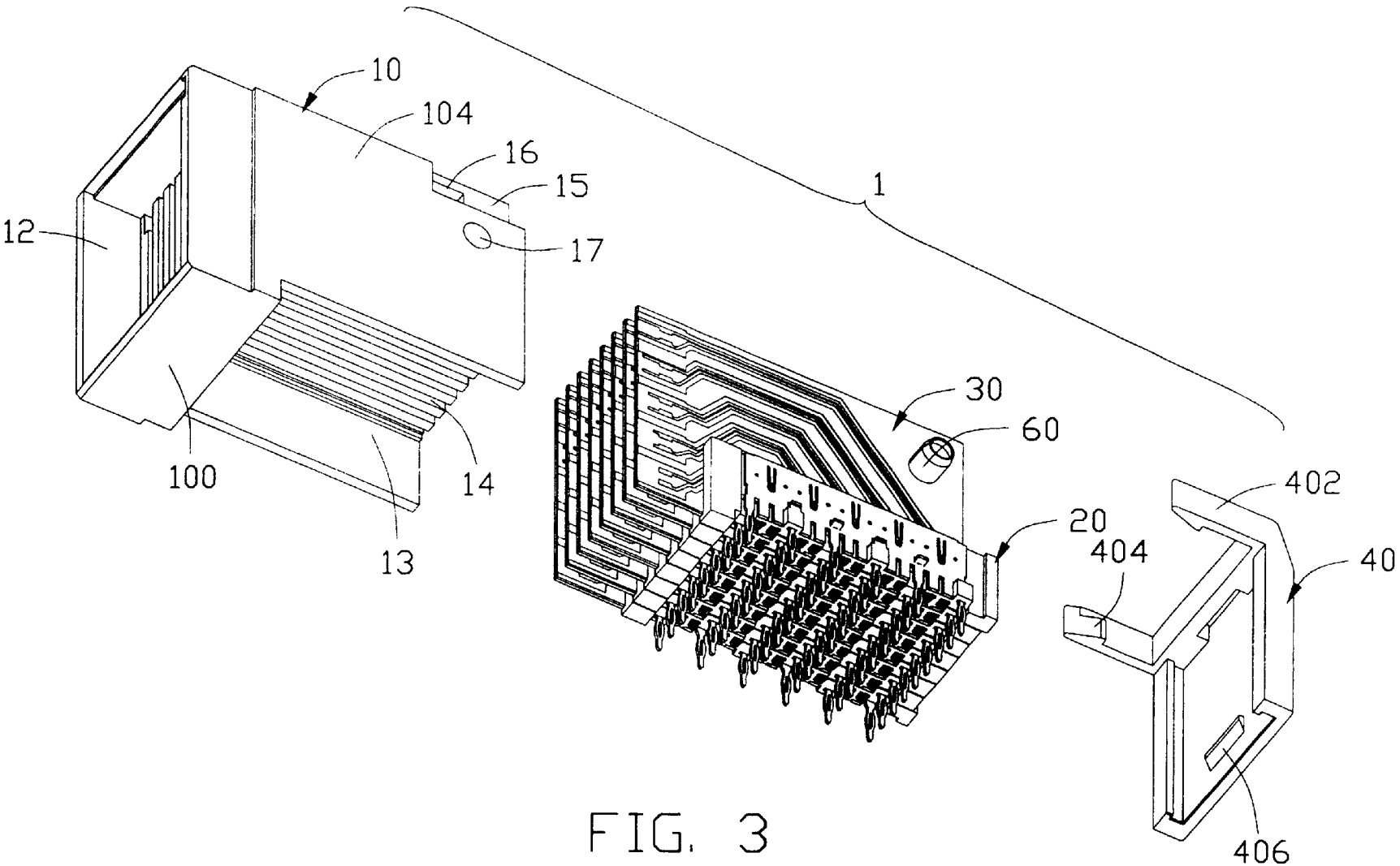
FIG. 3 is an exploded view of the receptacle.
Figure 4:
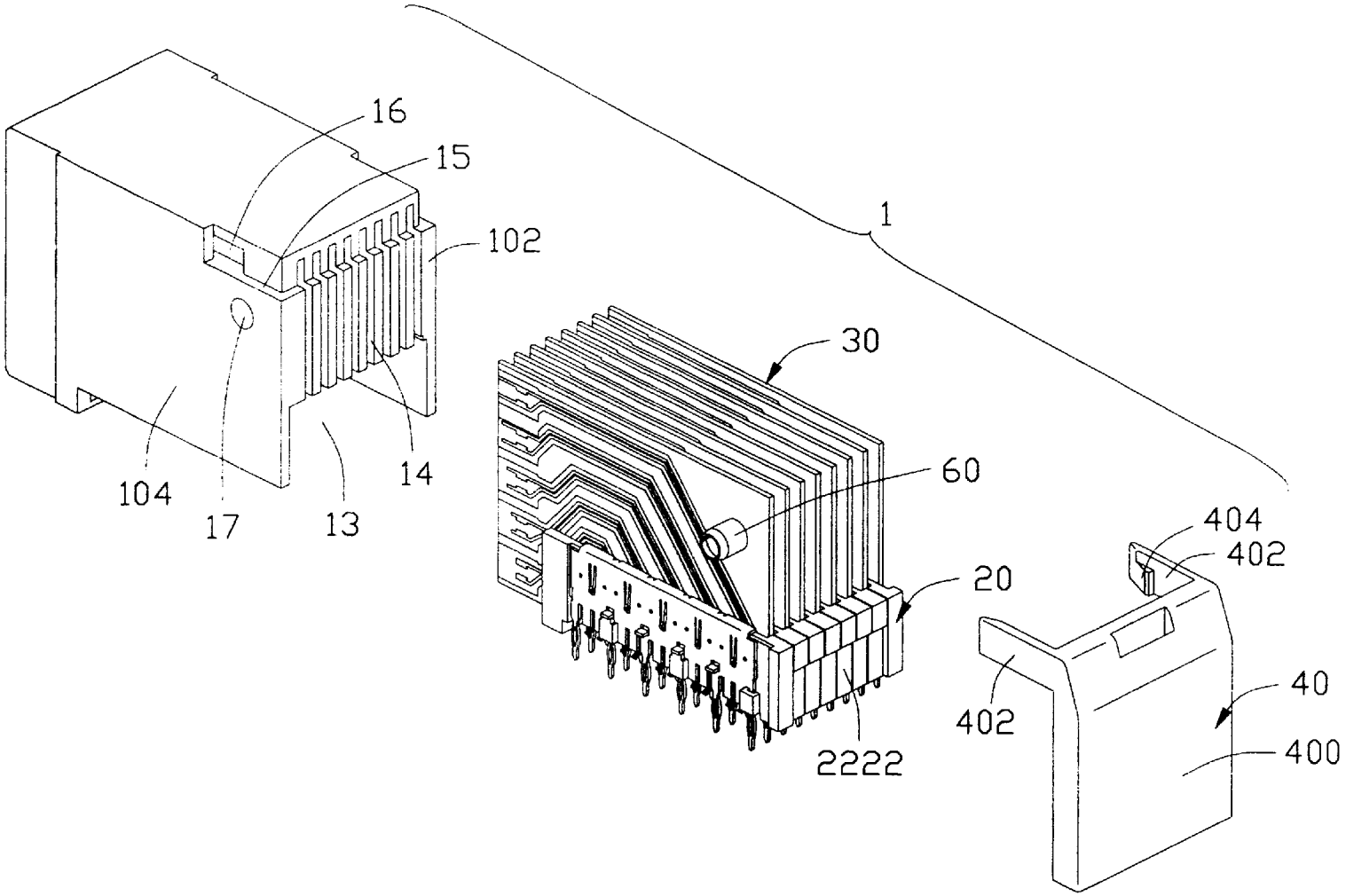
FIG. 4 is a view similar to FIG. 3 but taken from a different aspect.
Figure 5:
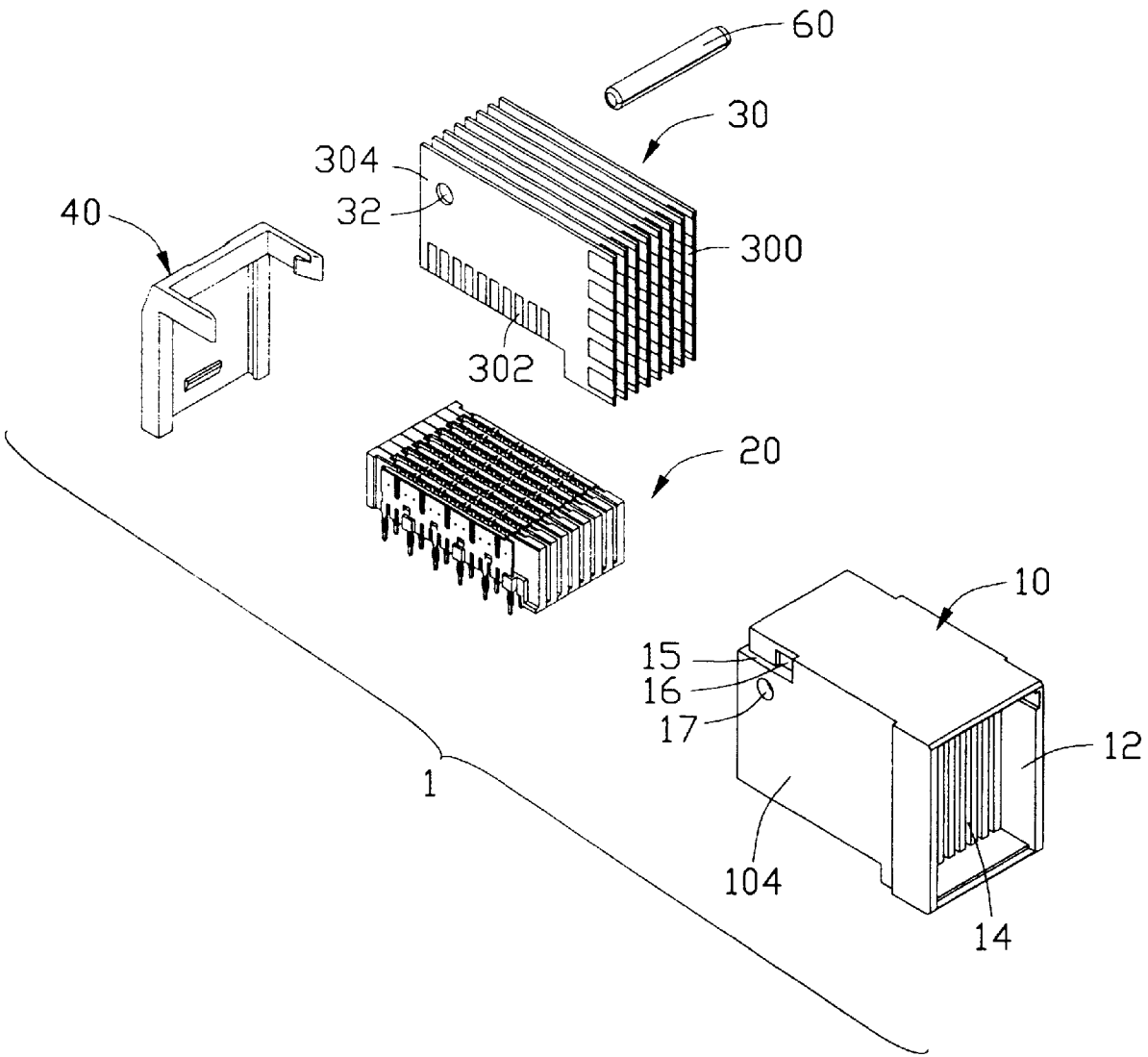
FIG. 5 is also an exploded view of the receptacle of the present invention, in which a interface connection piece, circuit boards and a cylindrical pin are further separated from each other.
Figure 12:
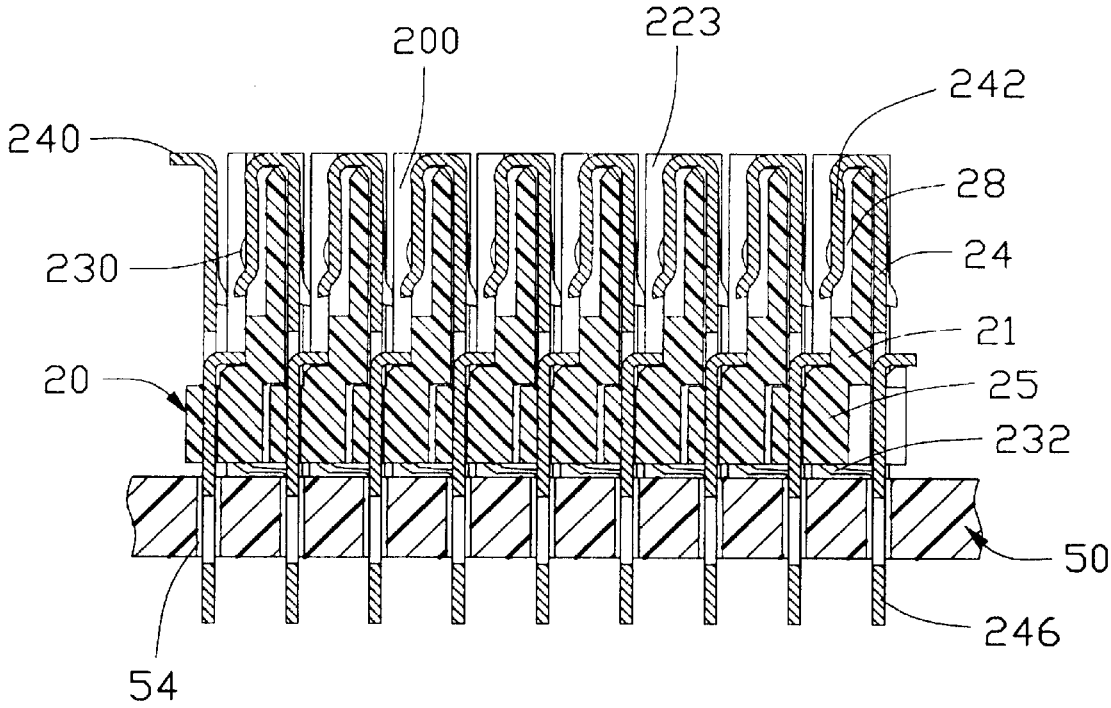
FIG. 12 is a cross-sectional view taken along section line 12—12 in FIG. 11, with the assembled wafers mounted on the daughter card.
Figure 13:
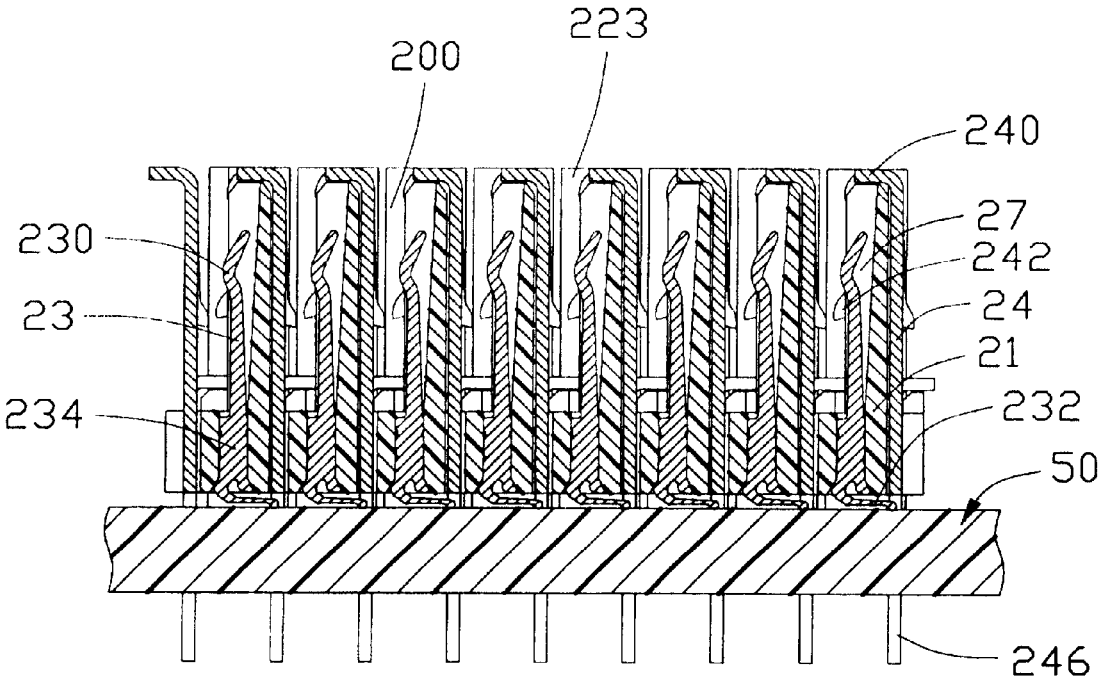
FIG. 13 is a view similar to FIG. 12 but taken along section line 13—13 in FIG. 11.
Figure 14:
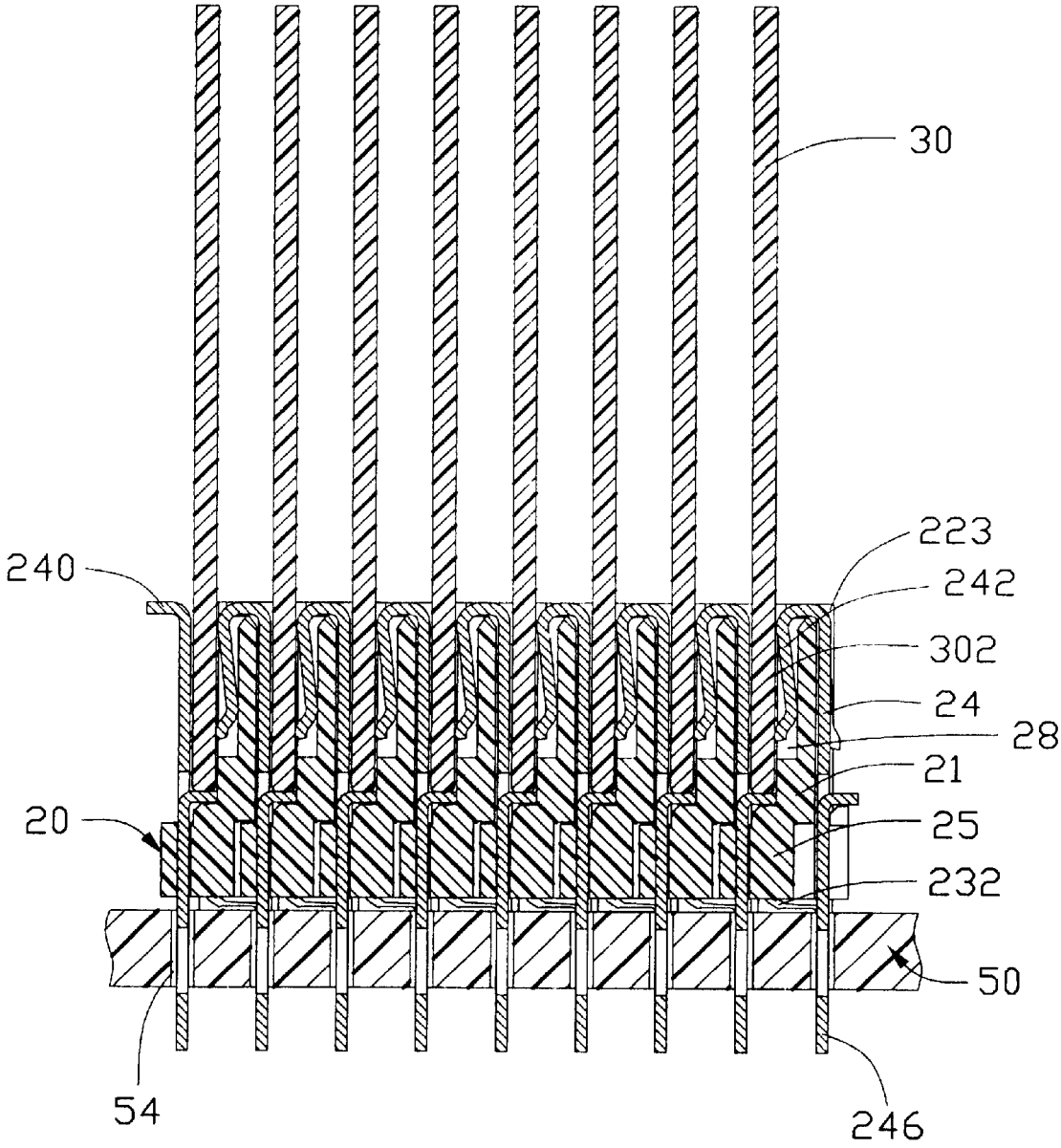
FIG. 14 is a view similar to FIG. 12 with the circuit boards being inserted into the wafers.

Referring to FIGS. 12–14 in conjunction with FIGS. 1–2, the receptacle 1 is mounted on the daughter card 50 to establish an electrical connection therebetween. The press-fit tails 246 of the grounding bus 24 are interferentially received in plated through holes 54 of the daughter card 50. The press-fit tails 246 of the grounding bus 24 not only establish grounding paths between the receptacle 1 and the daughter card 50, but also securely hold the receptacle I to the daughter card 50. At the same time, the bent tail portions 232 of the signal terminals 23 are compressibly engaged with signal pads (not shown) on the daughter card 50 for establishing signal traces between the receptacle 1 and the daughter card 50.

It is noted that the receptacle 1 has a plurality of grounding buses 24 disposed between adjacent rows of the signal terminals 23, and each of the circuit boards 30 located between adjacent rows of the signal terminals 23 has the grounding traces and the grounding plane respectively on the opposite sides of the circuit board. Both the grounding buses 24 and the grounding traces and the grounding planes on the circuit boards 30 function as shielding between adjacent rows of the signal terminals 23 to thereby achieve better electrical performance of the receptacle 1. In addition, the circuit boards 30 received in the first interface connection piece 20 are engaged with the signal terminals 23 and the grounding buses 24 of the wafers 21. Due to elasticity of the signal terminals 23 and the contacting legs 242 of the grounding buses 24, the circuit boards 30 are clamped in the first interface connection piece 20 and are electrically connected with the signal terminals 23 and the grounding buses 24. In other words, no additional retention mechanism is needed to fix the first mating portion 302 of the circuit board 30 in the receptacle 1, thereby facilitating the assembly of the circuit boards 30 in the receptacle 1 and reducing the manufacturing cost.

Figure 7:
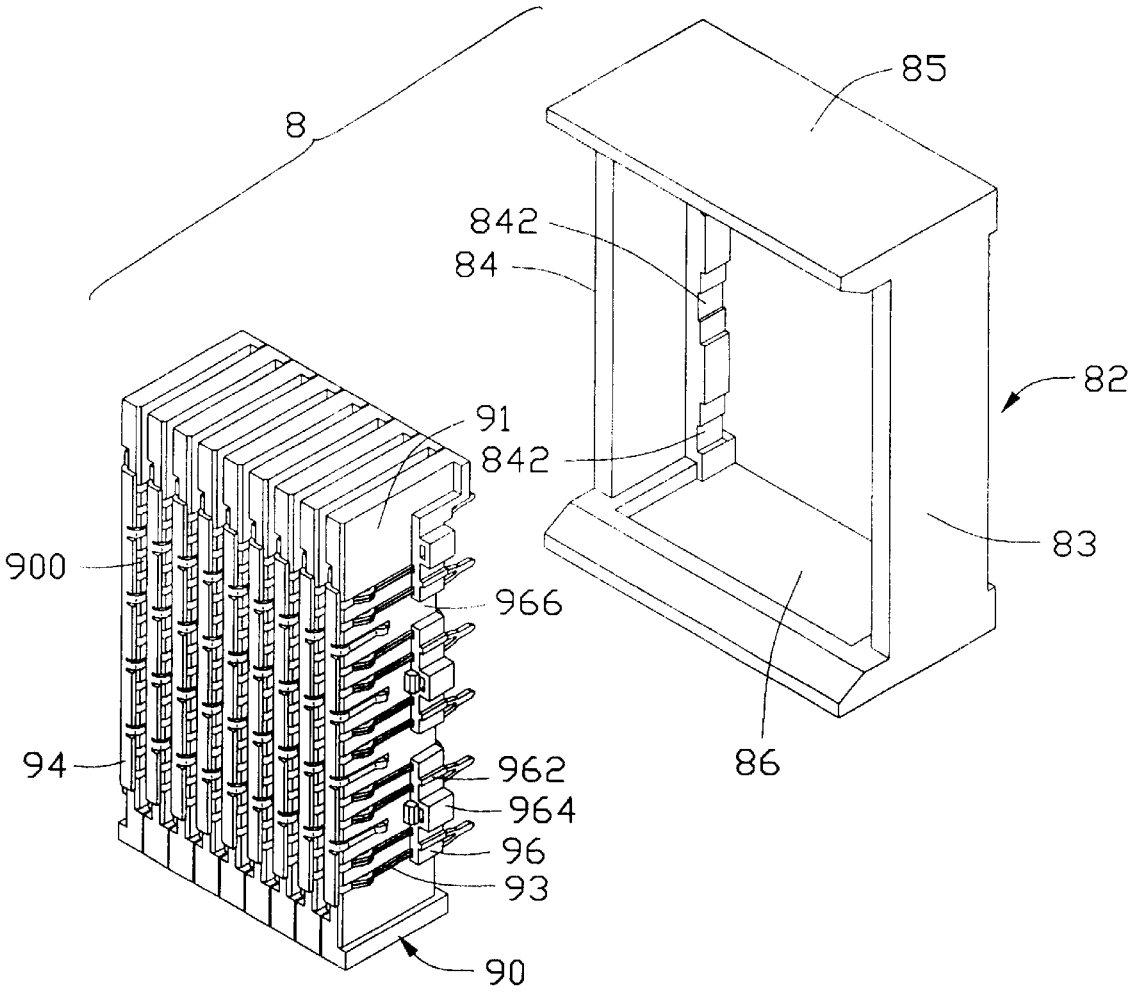
FIG. 7 is an exploded view of the header.
Figure 8:
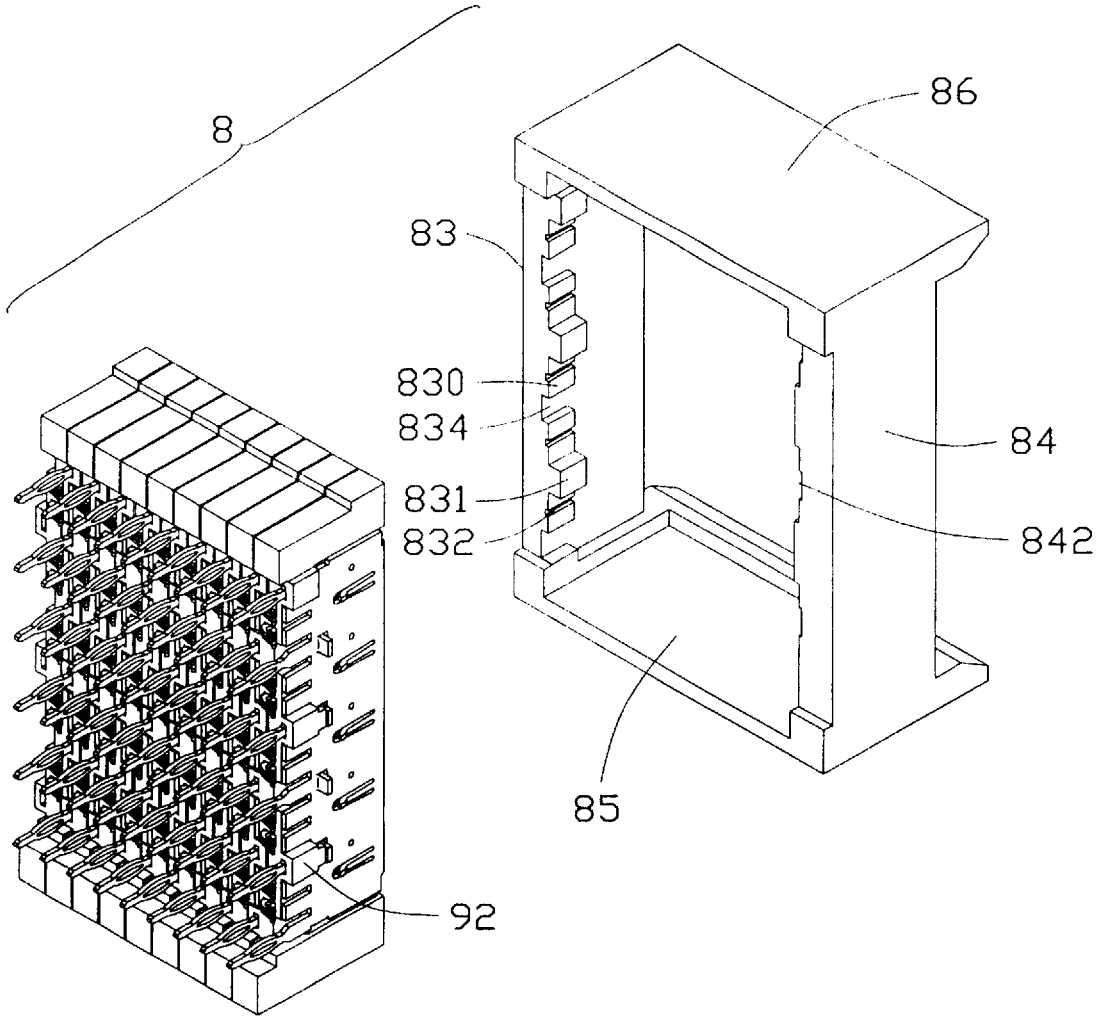
FIG. 8 is a view similar to FIG. 7 but taken from a different aspect.

Referring back to FIGS. 6–8, the header 8 comprises an insulative housing 82 and a second interface connection piece 90. The housing 82 has a first side wall 83, a second side wall 84, an upper wall 85, and a lower wall 86. The first side wall 83 forms a plurality of second blocks 830 on an inner surface thereof. Each second block 830 has a pair of grooves 832 and an embossment 831 located between the grooves 832. A recess 834 is defined between two second blocks 830. A plurality of channels 842 is defined in an inner surface of the second side wall 84.

The second interface connection piece 90 is configurated by a plurality of second wafers 91. The construction of the second wafer 91 of the header 8 is identical with the first wafer 21 of the receptacle 1 shown in FIGS. 9 and 10, thereby reducing the manufacturing cost.

In assembly, the second wafers 91 are engaged together by a first block 92 formed in one second wafer 91 engaging with a second block 96 formed in the other second wafer 91 thereby forming the second interface connection piece 90. The second interface connection piece 90 is assembled into the housing 82 with embossments 964 of a second wafer 91 locating at one distal side of the second interface connection piece 90 engaging into the recesses 834 of the first wall 83, ribs 962 of the second wafer 91 engaging into the grooves 832 of the first side wall 83, the embossments 831 of the first side wall 83 engaging into recesses 966 of the second wafer 91, and first blocks of a second wafer 91 locating at the other distal side of the second interface connection piece 90 engaging into the channels 842 of the second side wall 84.

The header 8 is mounted on the backplane 80 to establish an electrical connection therebetween.

When the receptacle 1 engages with the header 8, the mating portions 300 of the circuit boards 30 are inserted into slots 900 defined between two adjacent second wafers 91 of the header 9. The circuit boards 30 received in the second interface connection piece 90 are engaged with signal terminals 93 and grounding buses 94 of the second wafers 90. Electrical connection is established between the daughter card 50, the receptacle 1, the header 8, and the back plane 80.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly for electrically connecting with a printed circuit board and a backplane, comprising:

a receptacle having a first interface connection piece including a plurality of individual first wafers assembled together to define a plurality of slots between adjacent first wafers, each first wafer including a dielectric base and a plurality of signal terminals and a grounding member respectively mounted on opposite sides of the dielectric base, the signal contacts and the grounding member having tail portions for electrically connecting with the printed circuit board and contacting portions located at the same side of the dielectric base, a plurality of daughter circuit boards each having a first mating portion and a second mating portion, the first mating portions of the circuit boards being inserted into the slots of the first interface connection piece and electrically engaging with the contacting portions of the signal contacts and the grounding members; and a header for electrically connecting the backplane, having a second interface connection piece including a plurality of individual second wafers assembled together to define a plurality of slots between adjacent second wafers, each second wafer having an identical construction with that of the first wafer of the first interface connection piece, the second mating portions of the circuit boards being inserted into the slots of the second interface connection piece and electrically engaging with signal contacts and grounding members of the second wafers for establishing an electrical connection between the printed circuit board and the backplane;

wherein each wafer has a plurality of first and second blocks respectively on the opposite sides thereof in a staggered manner, and the first blocks of each wafer are interferentially fitted with recesses formed between adjacent second blocks of an adjacent wafer;

wherein the number of the tail portions of the grounding member is the same as that of the first and the second blocks on the opposite sides of the wafer;

wherein the tail portions of the grounding member extend through the first blocks of the wafer and the second blocks of the adjacent wafer for electrically connecting with the printed circuit board;

wherein the wafer defines a plurality of slots in one side surface thereof, the signal contacts being retained in the slots;

wherein the wafer defines a plurality of recesses in the same side surface of the slots of the wafer, and the grounding member has a plurality of contacting legs aligned with the recesses, the contacting portions of the grounding member being formed by the contacting legs for resiliently engaging with a corresponding inserted circuit board;

wherein the grounding member has a top flange covering a top edge of the dielectric base, and a plurality of contacting legs extending downwardly from the top flange of the grounding member for facilitating insertion of the circuit board, the contacting portions of the grounding member being formed by the contacting legs;

the receptacle further comprises a dielectric housing defining a plurality of parallel channels therein;

wherein each circuit board includes a mating portion aligned with a corresponding channel of the dielectric housing;

the receptacle further comprises a fastening device fixing the interface connection piece to the housing;

wherein the fastening device includes a wall contacting with the interface connection piece and a pair of latches perpendicularly extending from opposite side edges of the wall, each latch having a hook at a free end thereof; wherein the dielectric housing defines a pair of recesses in opposite sides thereof for accommodating the latches of the fastening device, and a pair of cavities recessed from the recesses for locking the hooks therein;

the header further comprises a housing and the second interface connection piece is securely received in the housing.

* * * * *